US007470092B2

(12) United States Patent
Bonasso

(10) Patent No.: US 7,470,092 B2
(45) Date of Patent: Dec. 30, 2008

(54) SYSTEM AND METHOD FOR REINFORCING AGGREGATE PARTICLES, AND STRUCTURES RESULTING THEREFROM

(76) Inventor: Samuel G. Bonasso, 208 Wagner Rd., Morgantown, WV (US) 26501

( * ) Notice: Subject to any disclaimer, the term of this patent is extended or adjusted under 35 U.S.C. 154(b) by 106 days.

(21) Appl. No.: 11/204,541

(22) Filed: Aug. 16, 2005

(65) Prior Publication Data

US 2006/0159526 A1 Jul. 20, 2006

Related U.S. Application Data

(60) Provisional application No. 60/644,901, filed on Jan. 19, 2005.

(51) Int. Cl.
*E02D 17/00* (2006.01)
*E02D 29/02* (2006.01)
*E02B 5/00* (2006.01)

(52) U.S. Cl. ..... 405/284; 405/302.4

(58) Field of Classification Search ..... 405/284, 405/302.4–302.6

See application file for complete search history.

(56) References Cited

U.S. PATENT DOCUMENTS

| | | | | |
|---|---|---|---|---|
| 4,318,642 | A | 3/1982 | Barnett | 405/284 |
| 4,850,738 | A | 7/1989 | Niemi | 404/31 |
| 5,056,961 | A * | 10/1991 | McMeans et al. | 405/284 |
| 5,160,215 | A | 11/1992 | Jensen | 404/46 |
| 5,480,255 | A * | 1/1996 | Bernaquez et al. | 404/6 |
| 5,846,021 | A | 12/1998 | Bailey et al. | 404/28 |
| 6,213,687 | B1 | 4/2001 | Broughton et al. | 405/258 |
| 6,268,035 | B1 * | 7/2001 | Carpenter | 428/64.1 |
| 6,457,912 | B1 | 10/2002 | Leibl | 405/302.4 |
| 6,464,432 | B1 | 10/2002 | Shaw | 405/286 |
| 6,484,473 | B1 | 11/2002 | Hall | 52/741.1 |
| 6,533,501 | B1 | 3/2003 | Callinan et al. | 405/229 |
| 6,652,197 | B2 | 11/2003 | Shaw | 405/286 |
| 6,705,803 | B2 | 3/2004 | Callinan et al. | 405/229 |
| 6,862,848 | B1 | 3/2005 | Lang et al. | 52/167.1 |

FOREIGN PATENT DOCUMENTS

| | | |
|---|---|---|
| JP | 09060013 | 4/1997 |
| JP | 10292397 | 4/1998 |
| JP | 11029927 | 2/1999 |
| WO | WO 98/49400 | 11/1998 |

(Continued)

OTHER PUBLICATIONS

Brochure entitled: "*Use of Discarded Tires in Highway Maintenance*", Translab Design Information Brochure No. TL/REC/1/88, Caltrans, Office of Transportation Laboratory Research and Enviro-Chemical Services Branch, Sacramento, CA, 7 pages, Jan. 1988.

(Continued)

*Primary Examiner*—Tara L. Mayo
(74) *Attorney, Agent, or Firm*—Baker Botts L.L.P.

(57) ABSTRACT

A method for forming a structure includes arranging a plurality of cylindrical segment elements on a surface. Each of the first plurality of cylindrical segment elements defines a cylindrical void therein. Aggregate material may be poured over the plurality of cylindrical segment elements such that the cylindrical voids are substantially filled with aggregate particles. The cylindrical segment elements limit lateral movement of the aggregate particles.

12 Claims, 10 Drawing Sheets

FOREIGN PATENT DOCUMENTS

| | | |
|---|---|---|
| WO | WO 00/08265 | 2/2000 |
| WO | WO 00/47829 | 8/2000 |
| WO | WO 03/048461 | 6/2003 |

OTHER PUBLICATIONS

Poh, Paul S.H., et al. "*Slope Stabilization Using Old Rubber Tires and Geotextiles*", Journal of Performance of Constructed Facilities, vol. 9, No. 1, pp. 76-79, Nanyang Technical Univ., Singapore, Singapore, Feb. 1995.

Youdeowei, P.O., et al. "*Local Engineering Practices of Erosion Control in the Coastal Areas of the Niger Delta*", Environ. Geol. Vo. 31, No. 3-4, pp. 231-235, Inst. Geosci. and Space Technol. (IGST), Rivers State Univ. Sci. and Technol., P.J.B. 5080, Port Harcourt, Nigeria, Pub. Springer-Verlag, Tiergartenstr 17, Heidelberg, Germany, Jun. 1997.

* cited by examiner

SYSTEM AND METHOD FOR REINFORCING AGGREGATE PARTICLES, AND STRUCTURES RESULTING THEREFROM

RELATED DISCLOSURE DOCUMENT

This application claims priority to Provisional Patent Application Ser. No. 60/644,901, filed Jan. 19, 2005, which is hereby incorporated by reference. This application is related to Disclosure Document No. 558525, which was received by the U.S. Patent & Trademark Office on Aug. 6, 2004.

TECHNICAL FIELD OF THE INVENTION

The present invention relates generally to structural foundation and support structures and more particularly, to a system and method for reinforcing aggregate particles, and structures resulting therefrom.

BACKGROUND OF THE INVENTION

The foundations of structures, such as bridges and buildings, are principally compressive structures. This is true because the soil and the rocks on which the foundation is placed are fundamentally compressive structures with negligible tensile strength. The action of transferring the loads from a bridge or building structure to the earth may be viewed as a process of transforming the tensile stresses and strains in structural materials into compressive stresses and strains; so these compressive stresses and strains can be transferred to the foundation of the structure and received by the soil and the earth A variety of inventions and designs have been developed throughout the history of construction to deal with this, lack of tensile strength, characteristic of soil. These inventions have primarily been to introduce various types of discontinuous tensile reinforcing. And while some rock does possess a determinable and predictable tensile strength, this tensile strength is rarely useful while the rock is part of the earth receiving the foundation loadings. Rock can withstand greater compressive loadings than soils and is therefore a better foundation for an above ground structure. It is primarily this greater ability of the rock to receive compressive stresses and compressive forces that makes it a more desirable foundation support.

New building materials products are relatively rare. Most modern building material products came from the last 150 years of industrialization. Modern products include: steel, steel-reinforced concrete, concrete "cinder" blocks, plastics, composites and methods of earth reinforcing, to name a few. Many of these, in their original form, were patented inventions. Prior to these modern products; wood, cut stone, bricks and soils, some glass, cement mortar and base metals were the main menu items from which nearly all construction occurred.

The most recent historical inventions to attempt to improve the ability of the soil to resist tensile loadings have been approaches which combine, with the soil, various types of discontinuous tensile materials in the form of tapes, straps, blankets, cloths, and the like of specific length, width and thickness. These discontinuous tensile materials are usually placed on top of a layer of engineered, compacted soil and then another layer of compacted soil is placed on top of the discontinuous tensile materials and the process is repeated until the desired height is achieved. These discontinuous tensile materials have the effect of integrating the soil into a large, three-dimensional, mass of material that generally combines the compressive properties of the soil with the properties of the discontinuous tensile materials.

The 2005 U.S. consumption of cement is estimated to be one hundred and eight million tons. The redimix concrete market is estimated at three hundred and forty million cubic yards, annually. Based on the cement production and using an average concrete mix design indicates that total concrete market is in the range of four hundred to six hundred million cubic yards.

The cement market in the U.S. is estimated to be distributed as follows:

| | |
|---|---|
| Utilities | 1% |
| Residential Buildings | 31% |
| Water and Waste | 8% |
| Streets & Highways | 32% |
| Farm Construction | 5% |
| Commercial Buildings | 10% |
| Public Buildings | 6% |
| Other | 6% |

SUMMARY OF THE INVENTION

The teachings of the present invention include a system and method for reinforcing aggregate particles, and structures resulting therefrom. In accordance with a particular embodiment of the present invention, a method for forming a structure includes arranging a first plurality of cylindrical segment elements on a surface, each of the first plurality of cylindrical segment elements defining a first cylindrical void therein. Aggregate particles are poured over the first plurality of cylindrical segment elements such that the first cylindrical voids are substantially filled with aggregate particles. The first plurality of cylindrical segment elements limit lateral movement of and resist the lateral pressure of the aggregate particles.

In accordance with another embodiment of the present invention, the method further includes arranging a second plurality of cylindrical segment elements above the first plurality of cylindrical segment elements, each of the second plurality of cylindrical segment elements defining a second cylindrical void therein. Additional aggregate particles may be poured over the second plurality of cylindrical segment elements such that the second cylindrical voids are substantially filled with aggregate particles.

In accordance with yet another embodiment of the present invention, a structure includes a first plurality of uniformly sized cylindrical segments arranged in a first plurality of rows such that each of the first plurality of uniformly sized cylindrical segments contacts at least three adjacent ones of the first plurality of uniformly sized cylindrical segments. A second plurality of uniformly sized cylindrical segments may be disposed upon the first plurality of uniformly sized cylindrical segments. The second plurality of uniformly sized cylindrical segments are arranged in a second plurality of rows such that each of the second plurality of uniformly sized cylindrical segments contacts at least three adjacent ones of the second plurality of uniformly sized cylindrical segments.

In accordance with a particular embodiment of the present invention, the second plurality of uniformly sized cylindrical segments may be offset from the first plurality of uniformly sized cylindrical segments by approximately one-half of the diameter of the first plurality of uniformly sized cylindrical segments. A generally uniformly sized aggregate material is disposed within and around the first plurality of uniformly sized cylindrical segments and the second plurality of uniformly sized cylindrical segments. The aggregate material and the first and second plurality of uniformly sized cylindrical segments may be selected to withstand a predetermined vertical gravity load.

Technical advantages of particular embodiments of the present invention include a structure including a plurality of cylindrical segment elements having aggregate particles disposed therein. Thus, when a vertical gravity load is applied to the aggregate particles, the cylindrical segment elements continuously absorb the tensile stresses that are generated by the lateral pressure in the aggregate particles as a result of the vertical gravity load, and constrain, or limit movement of the aggregate particles.

Another technical advantage of particular embodiments of the present invention includes reinforced aggregate particle units that may be used to form a support structure more economically than redimix concrete. Preliminary research indications demonstrate that the teachings of the present invention may allow for the construction of a support structure at a cost twenty five to fifty percent less than redimix concrete depending on the construction application, strength characteristics and quantities used.

Still another technical advantage of particular embodiments of the present invention includes a three dimensional building material product comparable to some regular redimix concrete or concrete blocks that is instantly ready to receive loads when placed and reduces construction time by as much as seventy-five percent in many applications. Moreover, the three dimensional building material may be removed with relative ease as compared to redimix concrete, and in many cases, at least a portion of the component parts may be reused and/or recycled more simply, and to a greater extent than concrete.

Other technical advantages will be readily apparent to one skilled in the art from the following figures, descriptions and claims. Moreover, while specific advantages are enumerated above, various embodiments may include all, some or none of the enumerated advantages.

DETAILED DESCRIPTION OF THE INVENTION

Figure 1:
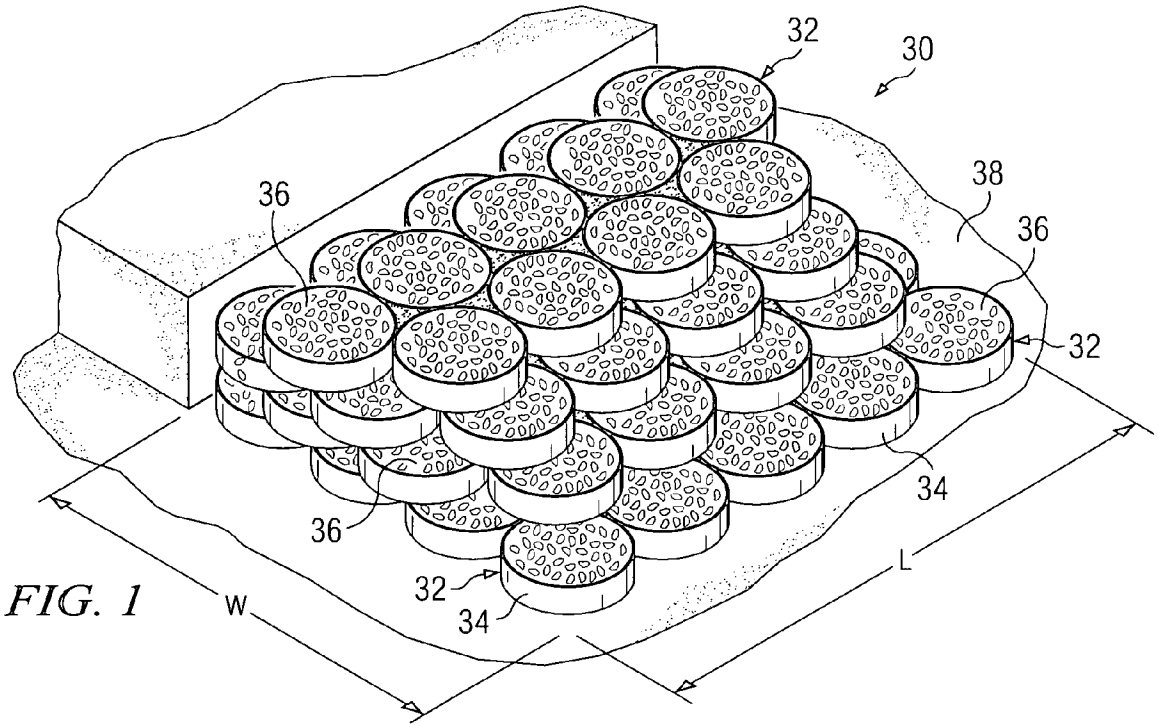
FIG. 1 illustrates a structure, formed on a surface, in accordance with a particular embodiment of the present invention.

The teachings of the present invention are directed to a method and system for integrating aggregate particles (e.g., rock, soil, man-made particles, or combinations thereof) into an engineered, three-dimensional, material structure requiring limited compaction and capable of supporting self-generated gravity loads, loads from foundations and other structures, and lateral loads. These material structures comprise three dimensional, building material products, that may be used in lieu of, or in addition to regular concrete, to form structures in heavy, general and residential construction.

As discussed above, the redimix concrete market in the U.S. is approximately three hundred and forty million cubic yards per year. Using twenty five percent of the redimix market as an estimated market potential of the present invention yields approximately eighty five million cubic yards of redimix concrete annually. At approximately one hundred dollars per cubic yard this is an eight and one-half billion dollar market. Portions of each of the markets discussed above would be targets for the three dimensional construction material of the present invention. There are also new markets that are not included in the above statistics, such as residential structural framing, which may be significant.

For the purposes of this specification, the definition of "aggregate particles" shall include, but not be limited to, any inert material such as soils, natural sand, manufactured sand, gravel, crushed gravel, crushed stone, vermiculite, perlite, blast furnace slag, glass, and/or other solid, granular and/or semi-solid materials, that may be used as construction backfill or to otherwise fill voids in structures. In any particular application, the aggregate particles may be provided in a generally uniform size and configuration, or various sizes and configurations of aggregate particles may be provided in a single application. The aggregate size and configuration will depend on the desired characteristics of the application, e.g. where drainage is critical a more uniform size aggregate insuring a certain percentage of voids would be used; where load bearing capacity is the critical element a more distributed size aggregate configuration would be used.

The material structure includes a plurality of cylindrical segment elements of specific diameter(s) and thickness(es) and of sufficient material size and strength to be capable of withstanding certain circumferential tensile stresses. The "cylindrical segment elements" may include any tubular, ring-shaped or other shaped components having a sufficient length so as to have at least a portion that includes a circular cross-section and/or a portion that defines a cylindrical-shaped void therein, and may include complete or partial top and/or bottom portions that further define such voids. The cylindrical segment elements may be selected, specified, designed, and/or fabricated based upon size, strength, cost and/or maneuverability, and engineered to cooperate with specified aggregate particles and other similar or identical cylindrical segment elements, to support a predetermined design load. Similarly, the aggregate particles may be selected, specified, designed and/or fabricated to cooperate with a specified cylindrical segment element(s), to support a predetermined design load and/or to serve some other purpose such as positive drainage.

The resultant material structure, including a plurality of cylindrical segment elements and aggregate particles, may be used to build foundations (e.g., bridge or building), dams, revetments, walls, supports, piers, columns, abutments, bridge decks, and/or other structures, and may also be used as a foundation and/or base layer for runways, highways, roadways, parking lots, sidewalks, railways, and/or bridges. Various other applications for the teachings of the present invention will be apparent to those of ordinary skill in the art including, but not limited to, unpaved golf cart and pedestrian paths, unpaved industrial roads, backfill behind bridge abutments (and other structures where active soil pressure should be minimized), retaining walls, embankments, bridge approach fills, fortifications, energy absorbing crash barriers, military runway and roadway repair systems, floodwalls, revetments, beach erosion systems, drain and gutter systems, storm water retention systems, water filter media systems, residential housing wall systems, and industrial structure wall systems. In accordance with a particular embodiment of the present invention, the cylindrical segment elements may be designed and fabricated for a specific application. Alternatively, existing materials may be used, for example an automobile or truck tire with both sidewalls removed or a section cut from a circular steel pipe, which provides the additional benefit of recycling pre-existing components that would otherwise require disposal.

Figure 2:
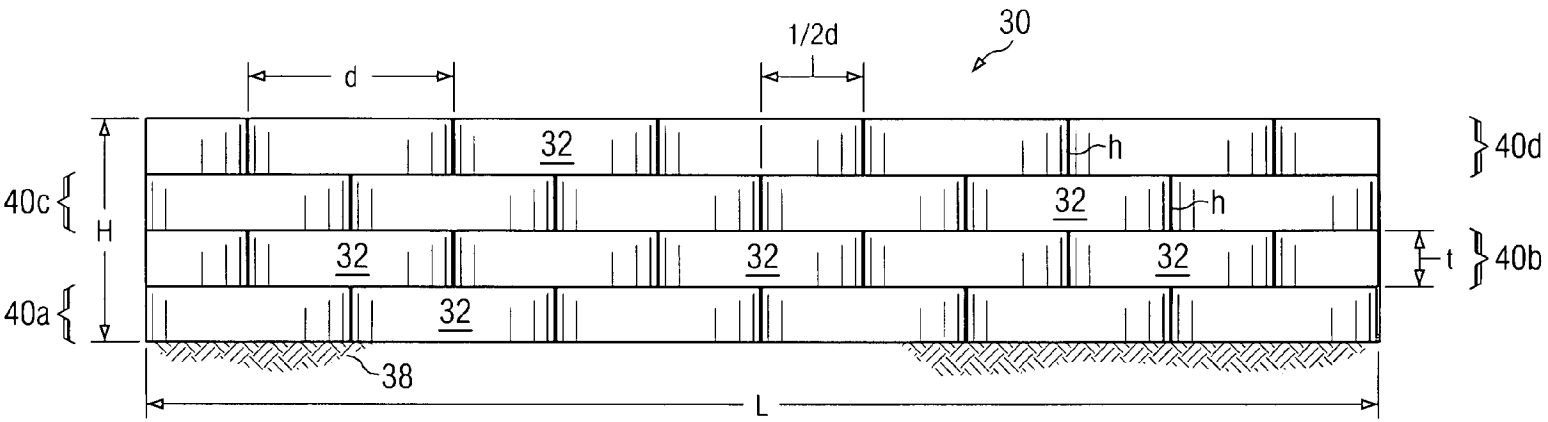
FIG. 2 illustrates a front perspective view, of the structure of FIG. 1.

FIGS. 1 and 2 illustrate an example of a material structure 30 that is made up of a collection of discrete, reinforced aggregate particle units 32. Each unit 32 includes a cylindrical segment element, or continuous tension ring 34 and aggregate particles 36. Each unit 32 is dependent upon the continuous tension ring 34, other units 32, and a surface 38 to rest upon, to maintain the integrity of the reinforced aggregate particle unit 32. Without the continuous tension rings 34, the aggregate particles 36 would simply be a collection of "loose" aggregate particles and their ability to support a vertical gravity load would be limited. Each unit 32 of material structure 30 is discrete and self contained, as long as the continuous tension ring 34 and surface 38 are provided. This distinguishes material structure 30 from reinforced soils, for example, which are created as a mass, layer by layer, with discontinuous tensile reinforcing and have no discrete integrated elements. Collecting these discrete elements into a structure system provides unit redundancy to the structure.

The continuous tension rings 34 may be referred to herein as Mechanical Cement™ and units 32 (e.g., tension ring 34 and aggregate particles 36) may be referred to herein as a Mechanical Concrete™ unit. The continuous tension ring 34 "binds" the aggregate particles 36 together mechanically (i.e., Mechanical Cement™) in a manner that is analogous to cement binding together aggregate particles to form concrete. Thus, the Mechanical Cement™ cooperates with the aggregate particles to form a discreet unit of Mechanical Concrete™.

The Mechanical Concrete™ relies upon supporting surface 38, the fluid like behavior of the aggregate particles 36, and the continuous tension ring 34 for its ability to withstand external loading, particularly vertical gravity loading. Each Mechanical Concrete™ unit is arranged with other like units to form a layer 40*a* on surface 38. A second layer 40*b* of Mechanical Concrete™ units may be placed upon the first layer 40*a* for example, in a block-like alternating pattern as illustrated in FIG. 1. Additional layers 40*c*, 40*d*, etc., of Mechanical Concrete™ units may be added to create a wall, or other type of structure of substantial height. In a similar manner, a single stack of Mechanical Concrete™ units could be used to create a column.

Concrete is formed into a mass by the binding action of a chemical reaction between the water and the cement, which, when set, binds its components together; and thus may be more descriptively called chemical concrete. The cement binder, which reacts chemically, is usually a type of Portland cement.

Mechanical Concrete™ uses mechanical methods of binding aggregates together to form a three-dimensional mass capable of supporting and transmitting gravity loads. It takes advantage of two basic physical properties of aggregate to achieve this binding process. First, a collection of aggregates are basically compressive materials with little effective tensile strength. Second, a collection of aggregates tends to exhibit a fluid like behavior in that when pressure is applied to the aggregates in one direction they tend to flow away from the pressure and also exert pressure lateral to the applied pressure. Large quantities of grains such as wheat and corn also exhibit this fluid like behavior characteristic, which is used in their effective handling, loading and unloading for storage and transportation.

Mechanical Concrete™ uses a continuous tension ring of a certain width, thickness and diameter, which may be a segment sliced normal to the axis of a cylinder, as the mechanical element to bind the aggregates into a mass. One example of such a circular ring segment would be the tread portion of a rubber, automotive vehicle tire. Such a circular element has the ability to resist tensile stresses that are directed outward from the axis of the circular element, toward the circumference.

As illustrated in FIG. 1, the tension rings 34 are placed side by side, on support surface 38 (e.g., a graded space of ground and/or the surface of another cylindrical segment) of certain area, so that an axis A through the center point of the cylindrical segment reinforcing element (See FIG. 4A) is directed vertically upward. Also, points on the surface 35 of each tension ring 34 are in contact with the surfaces of four adjacent tension rings 34, at points around the circumference of the tension ring 34 approximately ninety degrees from each other. In accordance with an alternative embodiment, the cylindrical segment elements may be spaced from one another. Such spaces may allow for aggregate particles to collect between adjacent cylindrical elements.

After the first layer of tension rings are arranged in this manner, the tension rings are then filled with the aggregate particles 36 and may be compacted so that the tension rings are substantially full. This forms layer 40*a* of reinforced aggregates of the desired width W and length L covering the desired area (e.g., W×L). A single "layer" (e.g., layer 40*a*) of such units may be sufficient to provide the necessary foundation and/or support structure for example, when used as the base for a roadway, runway, railway, pedestrian path or parking lot.

If the first layer 40*a* is not of sufficient height to meet the requirements of the construction, another layer 40*b* may be placed on top of the first layer. In accordance with a particular embodiment of the present invention, the tension rings of the second layer 40*b* may be offset from the tension rings of the first layer 40*a*, by one half of the diameter of the tension rings of the layer of 40*a*. Subsequent layers (e.g., 40*c* and 40*d*) may be added in a like manner, until the desired height H is reached. This is comparable to how brick or block are overlapped from one course to the next.

The result is a three dimensional, reinforced aggregate structure 30 having a height H, a width W and a Length L. Structure 30 may be designed such that it is capable of supporting itself and additional externally generated gravity, dynamic and lateral loadings. Structure 30 is a foundation base system, which may be designed to freely drain itself and elastically support the expected vertical, gravity and dynamic loadings. Structure 30, or a similar structure incorporating the teachings of the present invention may be used in practically any application which employs compacted backfill, aggregate particles, concrete, or any other type of support or structure. For example, depending upon its designed size and strength, structure 30 may be useful as a support for any of the structures described above.

Figure 3A:
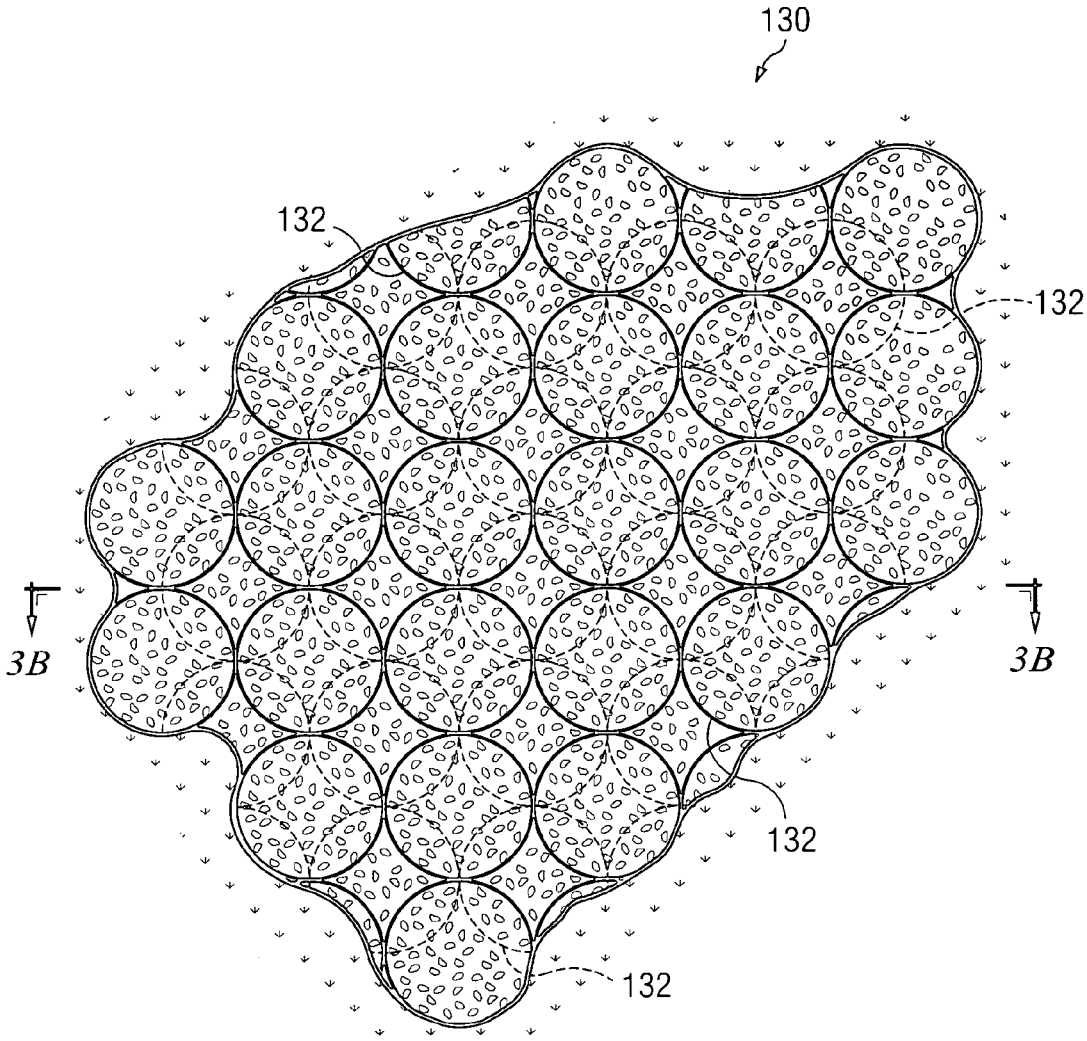
FIGS. 3A and 3B illustrates an irregularly shaped structure having a height H, formed in accordance with the teachings of the present invention.
Figure 3B:
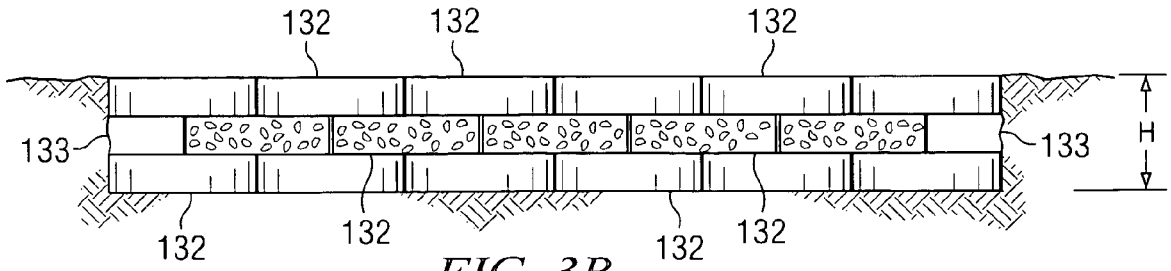

FIG. 1 illustrates reinforced aggregate structure 30 that is generally arranged in a rectangular configuration (e.g., footprint). However, it should be recognized by those of ordinary skill in the art that a reinforced aggregate structure of practically any configuration (e.g., circular, square, triangular, irregular shape, etc.) may be assembled within the teachings of the present invention. For example, FIGS. 3A and 3B illustrate a reinforced aggregate particle structure 130 that conforms to an irregular shape.

Aggregate structure 130 is illustrated as having a height H that is formed from three layers of reinforced aggregate particle units 132. A support structure 133 is illustrated in FIG. 3B as filling in the edge of the second layer, where an entire reinforced aggregate particle unit would not have fit. Support structure 133 may be formed of practically any material (e.g., plastic, metal, composite, etc.) and of practically any configuration to fill in areas in which a full reinforced aggregate particle unit 32 would not fit. Support structures 133 are particularly useful at edges and irregularly shaped portions of the reinforced aggregate particle structure. Support structures 133 may comprise solid or hollow structures, and may comprise partial and/or irregularly shaped cylindrical segment elements that may be filled at least partially with aggregate material.

Walls and foundations built using reinforced aggregate particle units in accordance with the teachings of the present invention may be built very quickly, and do not require the specialized materials, forms or craftsman that are used to form concrete or lay up block/brick walls. The resultant structures are very efficient, secure and energy absorbent.

Figure 4A:
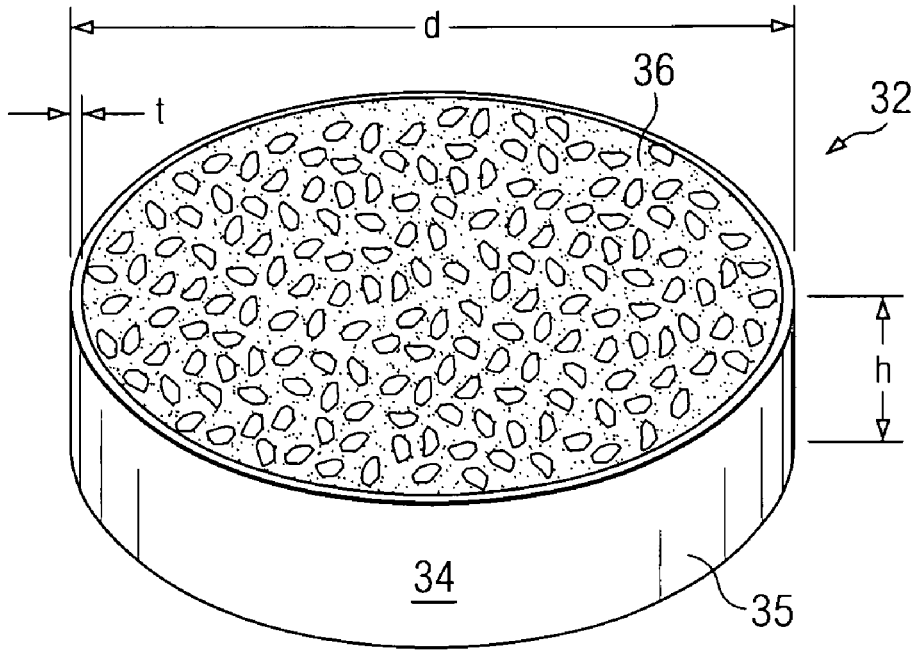
FIG. 4A illustrates a single unit of the structure of FIG. 1 including a cylindrical segment element, and aggregate material disposed therein, in accordance with a particular embodiment of the present invention.

FIG. 4A illustrates a single, reinforced aggregate particle unit 32, and its components and operation are described more fully below. In the illustrated embodiment, reinforced aggregate particle unit 32 has a diameter d, a height h, and a thickness t. Components of reinforced aggregate particle unit 32 may be selected based upon a number of factors. For example, the aggregate particles may be selected based, at least in part, upon their ability to support vertical and/or lateral loading. The tension rings 34 may be selected based, at least in part, upon their ability to withstand circumferential tensile stress and lateral loading. Tension rings 34 may be of practically any size suitable for a particular aggregate size and application, and the configuration may vary widely. The tension rings 34 may be made from metal, plastic, composites, rubber, and/or other materials or combinations thereof. It is anticipated that each application may benefit from an engineering analysis and associated selection of an appropriate material, strength, diameter, depth and thickness of the cylindrical segment elements. For any particular application, it is envisioned that ratios will be developed for the height, width, diameter and wall thickness of the tension rings, and the size, weight and strength of aggregate particles as they relate to the magnitude or range of loading that the units will be exposed to. The cooperation between tension rings 34 and aggregate particles 36 is described more fully below.

When any material is required to resist an external loading, the resisting material tends to either expand or contract as a result of the external loading influence. Many materials, such as metals, have both tensile and compressive strengths. These materials have the internal ability to resist the tendency to expand and contract as a result of external loadings. Other materials such as stone or concrete are primarily compressive materials and have negligible tensile strength and must be used in purely compressive structures or reinforced to resist tensile stresses. Some materials are better at resisting tensile loadings such as wires or fibers. Some materials can also be formed with geometrical cross sections to improve their ability to resist compressive loadings.

Soils and aggregate particles, such as ground-up large stones or small stones found in riverbeds or glacial deposits, tend to be primarily compressive materials. Soils and aggregate particles are usually compacted by applying repeated external loadings and in some cases, a certain amount of water, to improve their ability to come together to receive compressive loadings.

It is the characteristic of materials with both tensile and compressive resistive properties that, when they are placed under a loading from one axis direction that they exhibit predictable opposite stresses on the other two perpendicular axes in the three dimensions of space occupied by the material. The perpendicular loads are proportional to each other by a ratio that is characteristic of the elastic properties of the material known as the Poisson ratio. This orthogonal stress effect is sometimes referred to as the Poisson effect. For example, if a compressive loading is applied to a material from one direction, tensile stresses would occur within the material on lateral axes at ninety (90) degrees to the axis of compressive stresses. This can be observed by pressing down on a cube of cheese sitting on a table and observing that the sides tend to bulge out. When the material is observed three dimensionally, the compression of the material along one axis also generates an extension in the material along the other two orthogonal axes.

In a purely compressive material like a fluid or gas, the Poisson ratio is one. This means that the pressure or loading in one direction is fully transmitted along the perpendicular axis. In fact, for materials in a fluid or gaseous state the pressure is transmitted equally in all directions. Water pipes and hydraulic pressure hoses are designed to resist these types of predictable, perpendicular loadings. Uniformly sized, aggregate particles like grains, sand, gravel and other aggregate particles exhibit a fluid like behavior of transmitting a load from one axis to the perpendicular axis.

As a result of this characteristic, aggregates should have a variety of graded sizes in order to be compacted into an optimal, predictable, load resisting mass, for example, when used for a roadway or structure foundation base. Without this variety of graded sizes the aggregates tend to just ooze around when placed under load. In previous applications, this was generally thought of as an undesirable structural characteristic of uniformly graded aggregates.

This fluid like characteristic of uncompacted, rock aggregates is an important element in the design of some run-away truck ramps on mountain roads, allowing the truck to sink into the rock aggregate and be brought to a stop by the friction braking effect of the aggregate. It is also this fluid like effect of aggregates that may be used to advantage in accordance with the teachings of the present invention.

The aggregate particles of the present invention are reinforced by the cylindrical segment elements. The circumferential tensile strength of the cylindrical segment elements continuously provide the load resisting ability to withstand the Poisson effect. These rings do not dissipate their tensile stress into the surrounding material but continuously maintain it. This is in contrast to discontinuous tensile reinforcing which must dissipate its tensile stress through friction along its surface or through an end anchorage system. Again, the Poisson effect is created by the gravity and external compressive loadings that result in lateral pressure from the aggregate particles being transmitted to the cylindrical segment elements, since the aggregate particles are primarily a compressive material. Thus, the cylindrical segment element constrains the aggregate within its perimeter, and absorbs the lateral loads generated by the fluid like behavior of the aggregate as continuous circumferential tensile stresses.

Thus, each reinforced aggregate particle unit 32 of the present invention uses the fluid like behavior of the aggregate advantageously, to support vertical gravity loading. The fluid like behavior of the aggregate transmits forces from external loading to a lateral force against the cylindrical segment element, which binds the aggregate together, even under significant external loading. In this manner, reinforced aggregate particle units cooperate with adjacent, like units and the surface below to create a support structure of practically any size, strength, and configuration, for use in various applications.

A plurality of reinforced aggregate particle units can be arranged as a structure (e.g., the structure 30 of FIG. 1) to support a vertical gravity load. The vertical gravity loads from stacked reinforced aggregate particle units are transmitted through the aggregate particles to the ground. The tension rings continuously support the lateral forces generated by the fluid like behavior of the aggregate particles under vertical gravity loadings. The tension rings may also transmit some vertical gravity loads to the surface, but it will be a relatively small amount, as opposed to the vertical load transmission provided by the aggregate particles.

In accordance with a particular embodiment of the present invention, cylindrical segment elements may be selected based upon the ratio of the thickness t to the overall diameter d of the cylindrical segment element. For example, the teachings of the present invention allow for a relatively thin-walled cylindrical segment element to be used, since the cylindrical segment elements are not required to support any significant compressive loading. In one embodiment of the present invention, cylindrical segment elements may be selected such that the ratio of thickness to diameter (t/d) is equal to or less than 1/25.

The precise ratio that is selected will be based, at least in part, upon the specific material that is used to form the cylindrical segment element. For example, if tires having both sidewalls removed are used, it is anticipated that the ratio of thickness to diameter will be approximately 1/20 to 1/25. In another embodiment in which plastic cylindrical segment elements are used, it is contemplated that the ratio of thickness to diameter will be approximately 1/64 (e.g., d=20", 5/16"). In yet another embodiment, cylindrical segment elements that include metal may be used and the ratio of thickness to diameter may be approximately equal to or less than 1/100 (e.g., a range of 1/100 to 1/300).

Furthermore, the teachings of the present invention allow for relatively lightweight cylindrical segment elements to be used. For example, the overall weight of the cylindrical segment element may be less than ten percent of the weight of aggregate particles needed to fill the cylindrical void formed by the cylindrical segment element. In some embodiments, the overall weight of the cylindrical segment element may be equal to or less than five percent of the amount of aggregate particles needed to fill the cylindrical void formed by the cylindrical segment element.

Figure 4B:
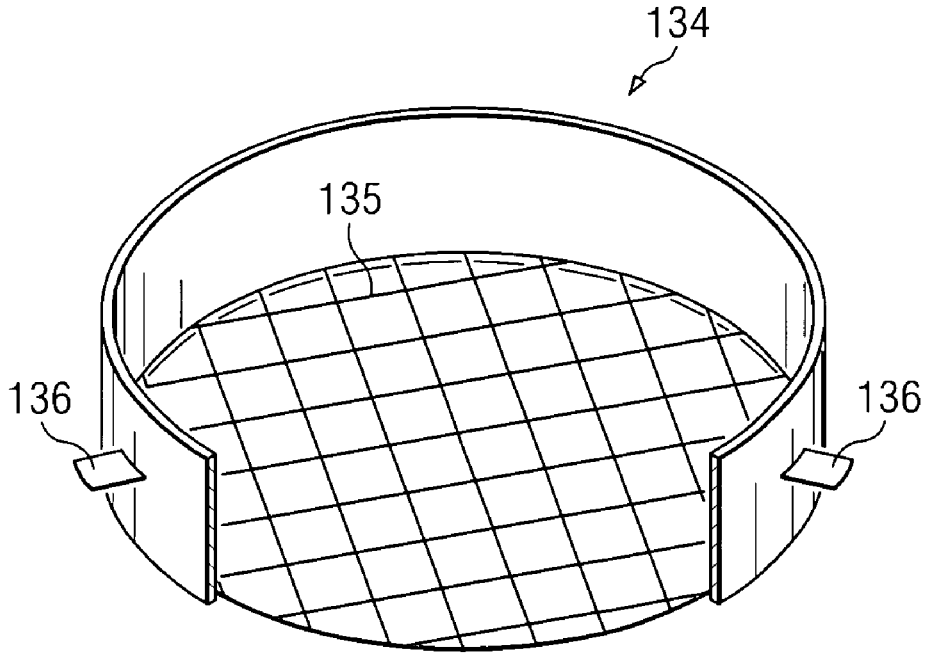
FIG. 4B illustrates an alternative embodiment cylindrical segment element, including a perforated bottom, and wing-like structures extending from an outer surface of the cylindrical segment element.

In accordance with a particular embodiment of the present invention, the cylindrical segment elements may include a partial bottom, or partial floor. For example, FIG. 4B illustrates a tension ring 134 that includes a perforated floor 135 that further constrains the flow of aggregate particles, and provides for ease of stacking and filling of tensions rings 134 with aggregate particles. Moreover, the perforated nature of floor 135 of tension ring 134 provides for drainage of any liquid that enters tension ring 134, for example rainwater, groundwater, etc. Another example of a cylindrical element with a partial floor or bottom and a partial top is a vehicle tire. Removing the sidewalls of the tire leaves a small lip which provides a partial floor allowing any water to drain out and a partial top to allow aggregate from the element above to come in contact with the aggregates of the element below.

Floor 135 of FIG. 4B is perforated, in a screen-like configuration. The perforations may be sized and configured to correspond with and/or accommodate particular aggregate sizes, in various applications. However, in alternative embodiments, the partial floor may be a solid structure, or it may be perforated in another manner, for example in a pattern such as four circular openings, to allow for drainage of fluids and/or smaller debris.

A simple tension ring without a partial floor provides sufficient benefit, but the system may be further enhanced for particular applications by including a partial floor. Moreover, the tension ring may be provided with wings 136, fittings, or other components to promote alignment and organization for facilitation of construction of a structure composed of reinforced aggregate particle units. The wings 136 may be provided at ninety degrees to adjacent wings (for a total of four) or at one hundred and eighty degrees to each other (for a total of two) or practically any other configuration. The wings may also be configured such that they may be used to couple adjacent cylindrical segment elements together, and ensure proper spacing, and alignment. In another embodiment, straps (e.g., plastic straps) may be used to secure adjacent cylindrical segment elements together, in order to maintain a particular arrangement of cylindrical segment elements, during construction of the structure.

Figure 5:
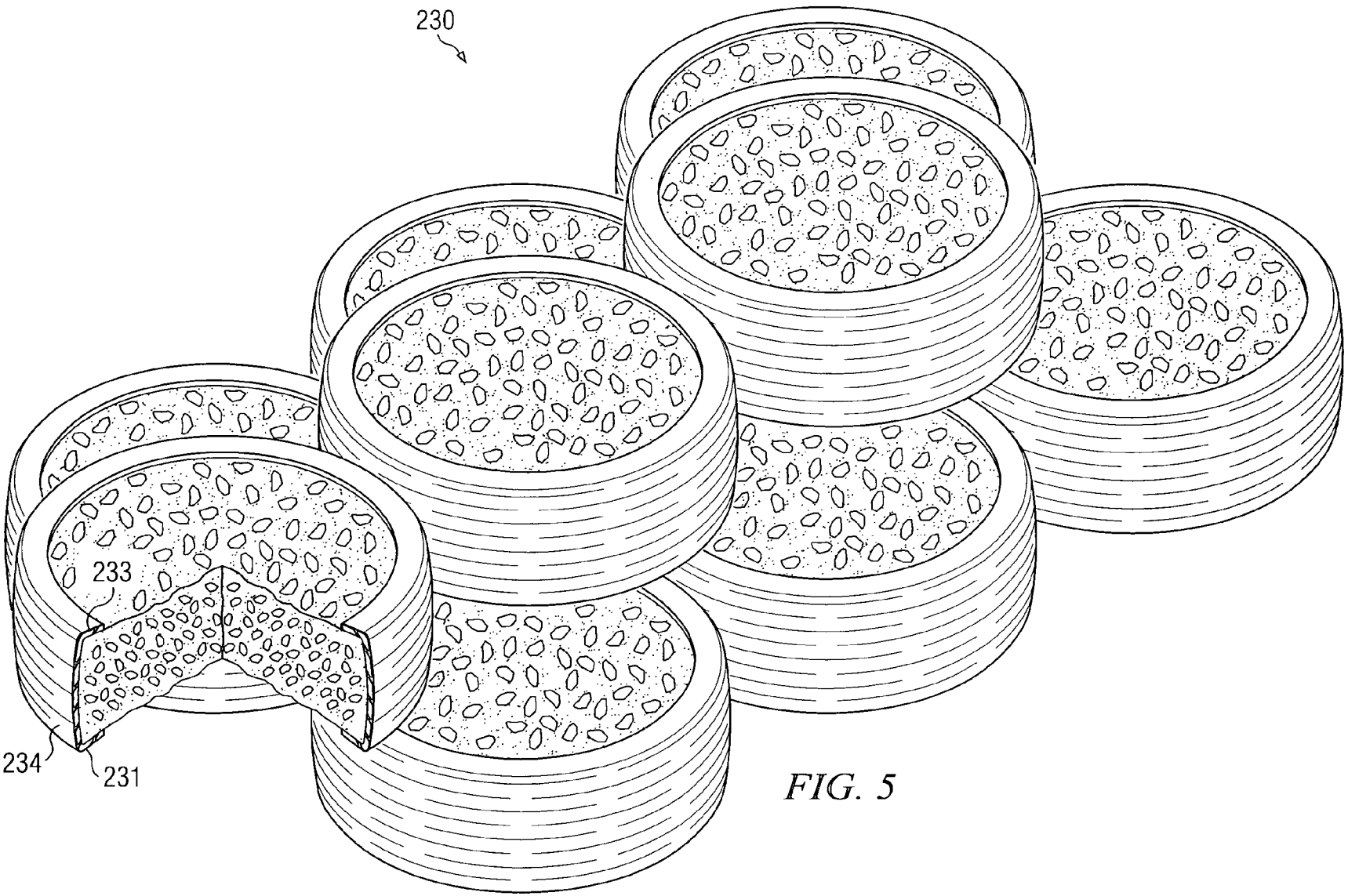
FIG. 5 illustrates a structure including a plurality of vehicle tires with both sidewalls removed and substantially filled with aggregate particles, in accordance with an alternative embodiment of the present invention.

In accordance with another embodiment of the present invention, the cylindrical segment elements may comprise tires with both sidewalls removed leaving a small lip that are used in lieu of, or in addition to tension rings. For example, an alternative embodiment material structure 230 is illustrated in FIG. 5. The small lip partial floor 231 of tires 234 may be used advantageously to facilitate ease of construction. For example, the hole in a tire that is formed by removing the sidewalls allows drainage, while the small lip creates both a partial floor 231 and a partial ceiling 233 for the reinforced aggregate particle unit. Partial floor 231 and partial ceiling 233 promote alignment and stacking as a practical construction methodology. In accordance with a particular embodiment of the present invention, the aggregate particles may comprise river rock. In accordance with another embodiment of the present invention, common quarried, screened stone (e.g., #8) may be used in lieu of, or in addition to river rock.

Using a tire with both sidewalls removed and aggregates to create Mechanical Concrete™ can be accomplished as follows: (i) a tire is placed on the ground; (ii) relatively uniform sized aggregates are deposited onto the ground through the opening in the center of the tire; (iii) as these aggregates are piled up they tend to flow out away from the center towards the circumference of the tire; (iv) with some limited spreading and compaction the aggregates will fill the inner space of the tire and form a condensed mass, which is bound together by the tire tread material.

In the above described Mechanical Concrete™ configuration, when a vertical load is applied to a top surface of the aggregates, they will transmit the load vertically downward toward the ground and will also exhibit their fluid like behavior and tend to flow away from the load in the direction of the circumference of the tire(s). However, the aggregates are now restrained by the tire, and the fluid like behavior and from flowing away from the applied load is resisted by the material in the tire tread portion of the tire. This fluid like behavior tendency of the aggregate, created by the applied load, results in a circumferential tensile stress in the tire tread material. The tread resists this stress and, in resisting, acts to hold the condensed mass of aggregates together and allows the condensed aggregate mass to transmit the vertical load to the ground beneath the Mechanical Concrete™ element.

Over the years, many efforts have been made to dispose of and/or recycle used tires from vehicles and equipment (e.g., autos, military or construction equipment). Today, many such tires are stockpiled, land filled, shredded up into shreds or burned for fuel. The teachings of the present invention provide a mechanism to use such tires in an advantageous way, and otherwise eliminate the need for alternative disposal.

Recycled tires have been used as backfill and base material (e.g. playground surface) in prior applications, but not in the manner proposed by the present invention. For example, tires are widely used in roadway bases and embankments, but they are processed (shredded, crushed, torn) prior to such use. Thus, the tires must be transported, handled, processed, and transported again to the ultimate destination. All such transportation and processing requires energy, money and resources, and results in undesirable pollution. Moreover, shredding the tires destroys the inherent ability to be used in accordance with the teachings of the present invention to resist lateral tensile stress of axially compressed aggregate within the tires.

In accordance with a particular embodiment of the present invention, modifications may be made to the tires, to suit a particular application. The sidewalls are removed. This allows for easier filling of the tire with aggregate particles. Other modifications may also be made to the tires for example, holes or notches may be added to allow two or more tires to be secured together.

In many instances, used tires may be located at or near locations where they can be used advantageously. For example, in a military theater of operations, heavy vehicle and equipment use result in an abundance of worn tires. One advantage of the present invention is that the tires with both sidewalls removed can be used to form foundations and walls for various structures that are typical in the theater, for example temporary bridges, roadways and buildings. Moreover, in a relatively simple and effective application, reinforced aggregate particle units may be stacked in a circular configuration around buildings for protection from attack, mortar fire, or vehicle assault.

Similarly, racetracks of all kinds generate an abundance of worn tires that require disposal. Advantageously, the teachings of the present invention allow for the use of such tires to provide a foundation to both permanent and temporary roadways, and buildings. The reinforced aggregate particle units may also be designed and used to construct temporary and permanent protection walls and barriers (e.g., crash barriers).

Preliminary tests with auto tires with both sidewalls removed indicate that approximately thirteen and one-half tires may be used to form a column of one cubic yard of Mechanical Concrete™. This uses as a standard, a sixteen inch rim tire (approximately twenty-four inch outside diameter, and approximately nine inches of tread width) using this estimate, the annual 85 million cubic yard target market of redimix concrete could consume the total annual U.S. market of scrap tires, and also consume several hundred million additional cylindrical segment elements.

Using the vehicle tire market as an example, tire dealers are currently paying to have scrap tires hauled away and disposed of. This means that they have a negative value in the market place. Their principle uses are as fuel and shredded as an embankment fill material. Auto tires with both sidewalls removed are thus a source of inexpensive rings for Mechanical Concrete™.

With a one dollar per tire royalty and including other costs plus customary contractor overhead and profit yields a material comparable to general use concrete at a price approximately twenty-five to fifty percent below redimix concrete, and ready for use in approximately ten to forty percent of the construction time of redimix concrete, for many applications.

Figure 6A:
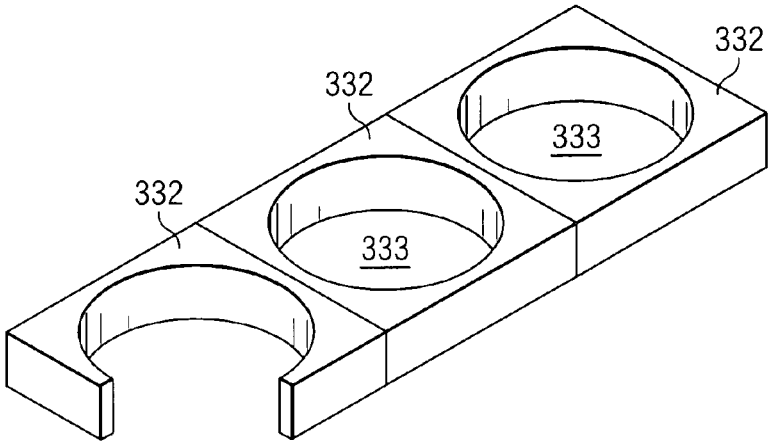
FIGS. 6A and 6B illustrate a plurality of cylindrical segment elements, in accordance with an alternative embodiment of the present invention.

FIG. 6A illustrates a plurality of alternative embodiment cylindrical segment elements 332, suitable for use within the teachings of the present invention. Cylindrical segment elements 332 comprise square-shaped forms defining cylindrical openings 333 therein. Cylindrical openings 333 may be filled with aggregate material 36 to form a reinforced aggregate particle unit of the present invention. Providing cylindrical segment elements 332 of a square-shaped or rectangular-shaped configuration may be particularly suitable for the construction of walls of buildings, or other structures that are more architectural in nature than typical underground foundation systems. The flat sides of such elements allow for simple alignment and construction of walls or other structures with "clean" lines wherein the units are substantially aligned with one another.

As with all of the reinforced aggregate particle units described herein, a system utilizing cylindrical segment elements 332 may be used in practically any application that concrete block may be used in. However, cylindrical segment elements 332 may be particularly useful as a replacement for concrete blocks and other types of wall framing systems, due to the configuration of cylindrical segment elements 332. Moreover, an architectural brick face may be applied to one side of the structure, to form the wall of a building. On the "interior" side of the structure, ties or other fasteners could be used to apply plywood, framing members, and/or drywall, for a finished construction.

Figure 6B:
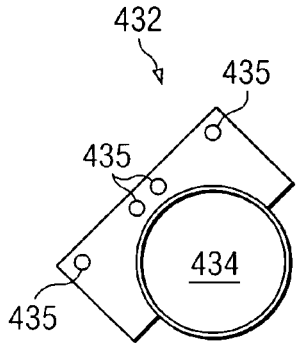

FIG. 6B illustrates yet another alternative embodiment cylindrical segment element 432 that incorporates aspects of the present invention. Cylindrical segment element 432 may be used in practically any application, for example as a replacement for brick or blocks in wall construction. Approximately one-half of cylindrical segment element 432 includes a rectangular configuration similar to cylindrical segment element 332 of FIG. 6A. The other half includes one-half of a cylindrical ring 434.

Cylindrical segment element 432 may be used as the facing of a wall structure that is otherwise formed of tires or other cylindrical elements. Holes 435 are provided at each corner and along the center of the face. Holes 435 accommodate dowels to align and/or support overlapping elements, similar to a course of brick.

Figure 6C:
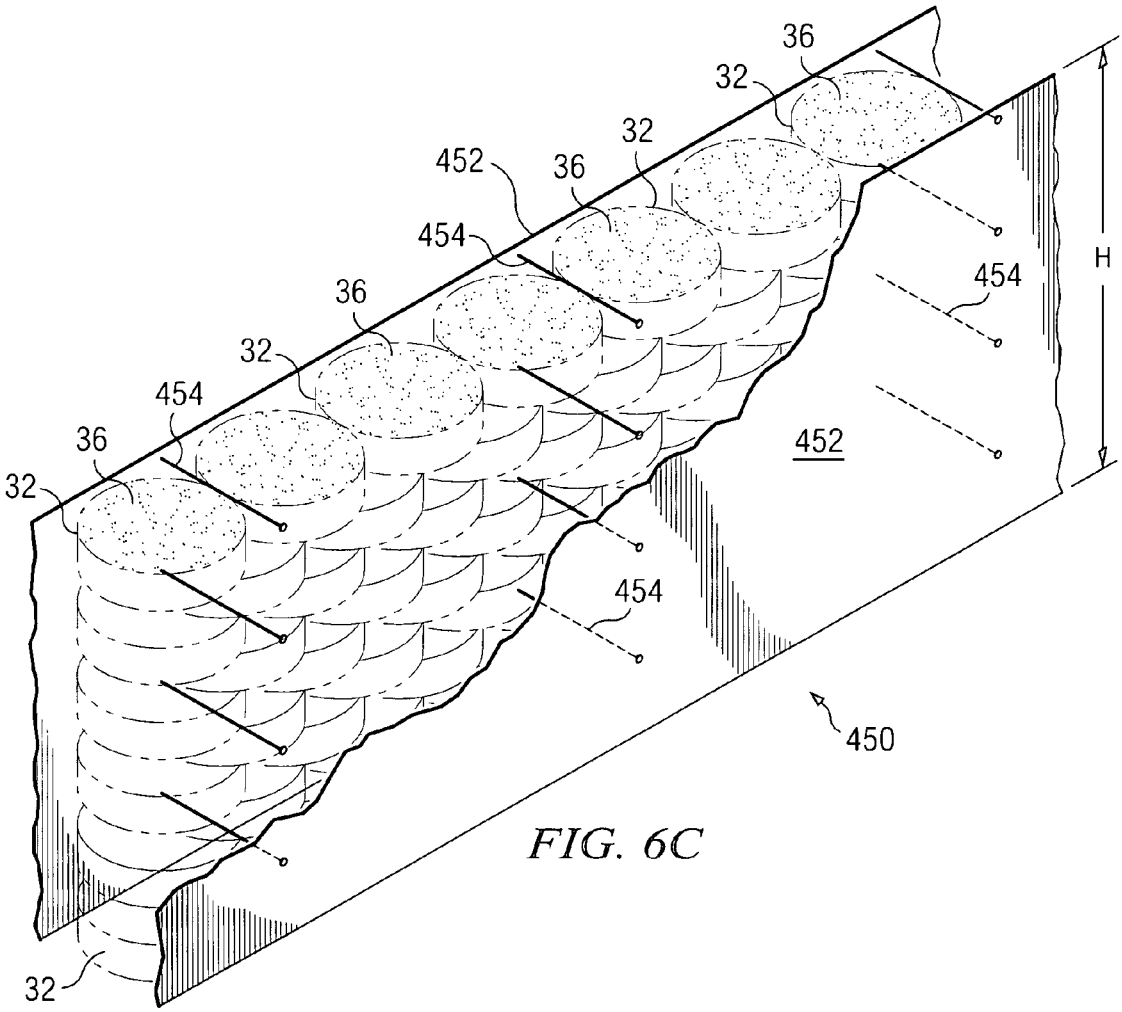
FIG. 6C illustrates a wall, formed in accordance with the teachings of the present invention.

FIG. 6C illustrates another embodiment of the present invention, in which a wall 450 is formed from a plurality of cylindrical segment elements 32 and aggregate particles 36. Wall 450 is formed using a single row of cylindrical segment elements, stacked to a height H.

Wall 450 also includes exterior sheets 452 used to constrain any loose aggregate particles. Exterior sheets 452 may be formed of practically any material, for example, sheet metal, plastic, composite, etc. Sheets 452 are held in place with respect to each other using a plurality of ties 454 which extend through the interior of the wall, a couple sheets 454 together.

Although the wall of FIG. 6C is illustrated as a single row of cylindrical segment elements and is therefore approximately one diameter of the cylindrical segment elements in width, it should be recognized by those of ordinary skill in the art that sheets 452 may be used in a similar manner on walls formed from any number of rows of cylindrical segment elements. Sheets 452 may also be used on the ends of the wall 450, to constrain the aggregate particles from escaping through the ends.

Figure 6D:
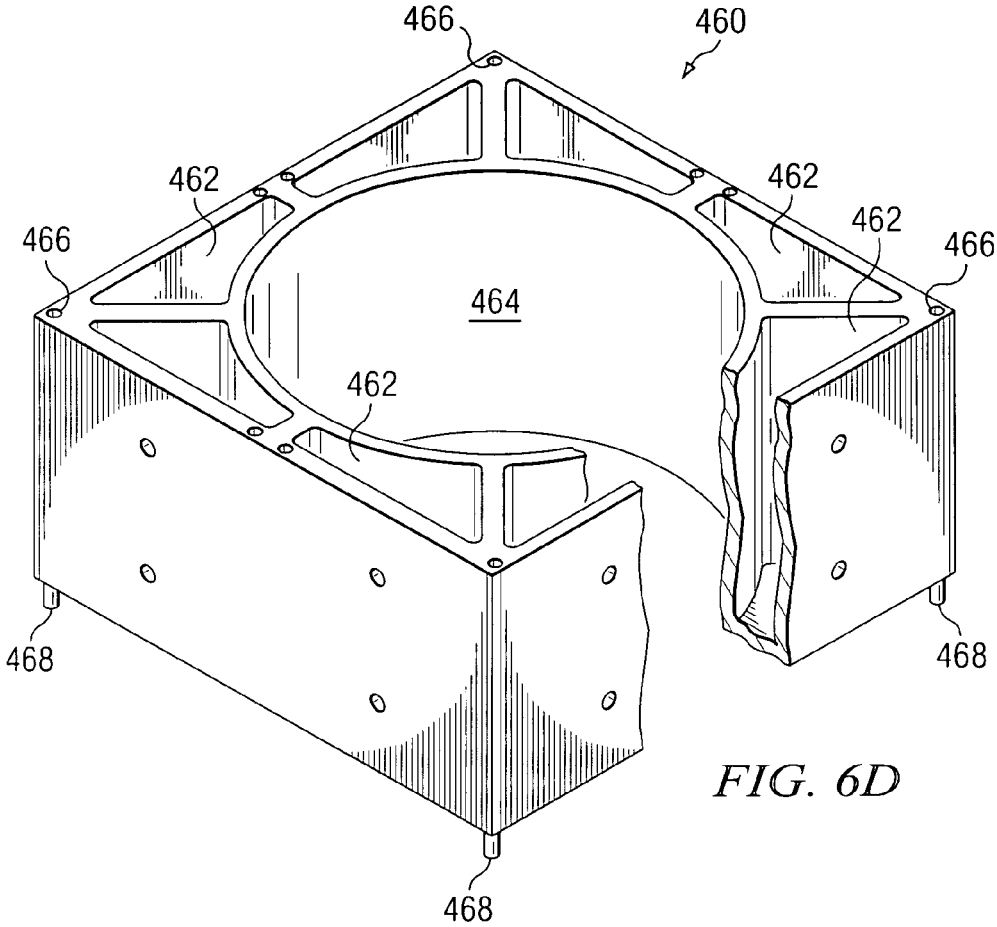
FIG. 6D illustrates another cylindrical segment element in the form of a square block, in accordance with another embodiment of the present invention.

FIG. 6D illustrates an alternative embodiment cylindrical segment element 460, available for use within the teachings of the present invention. Segment 460 includes a generally square-shaped exterior, although other shapes are available (e.g., rectangular) and depend at least in part upon the desired application. In the illustrated embodiment, element 460 includes twenty-four inch (24") sides, measured along the exterior.

A plurality of cells 462 are formed inside of the walls of element 460, and define a generally cylindrical opening 464 at a central portion of element 460. In accordance with a particular embodiment of the present invention, the cylindrical opening may include a diameter of approximately twenty inches (or approximately ⅚ of the overall width of the cylindrical segment element). Each of the cells are defined by walls that extend from the exterior of element 460 to the generally cylindrical opening 464. In the illustrated embodiment, each cell 462 includes an open top, but includes a "floor" at its bottom portion. The optional floor at the bottom of the cells may provide one or more of many advantages. For example, the floor provides stability to the element 460 when the element 460 is stacked upon one or more additional elements, or on grade or any other surface. The floor also ensures that aggregate material that collects in the cells will not escape after the cell is filled with aggregate particles. In an alternative embodiment of the present invention, a full or partial floor may provided at the bottom of cylindrical opening 464 in addition to, or in lieu of the floor at the bottom of cells 462.

In accordance with a particular embodiment of the present invention, cylindrical segment elements 460 comprise injected molded plastic. The particular material and/or design of cylindrical segment elements 460 will be based, at least in part, upon the specific application(s), and the strength, flexibility and weight of the particular material.

In the illustrated embodiment of FIG. 6D, cylindrical segment element 460 is provided with a plurality of alignment holes 466 on a top side of the element 460, and corresponding alignment pins 468 on the bottom side of the element 460. Alignment holes 466 and pins 468 allow for proper alignment and seating of a plurality of cylindrical segment elements during stacking. The configuration of FIG. 6D allows for vertically aligned stacking, or stacking in which cylindrical segment elements are offset by approximately one-half of the width of the cylindrical segment element. Four and one-half inch diameter knock-outs are also provided on each face of the element 460, to accommodate push fasteners or bolts. This allows the cylindrical segment element 460 to be secured to one or more horizontally aligned, adjacent cylindrical segment elements.

Each of the cylindrical segment elements of FIGS. 6A, 6B and 6D include cylindrical shaped voids that are defined by the structure of the cylindrical segment elements. However, the exterior portion of the cylindrical segment element takes on a different geometric configuration. For example, the exterior of the cylindrical segment element may be in the shape of a square (e.g., FIGS. 6A, 6D) or rectangle, to allow for ease of construction and easier incorporation into traditional building structures. FIG. 6B includes a partial-rectangular exterior and a partial semi-cylindrical exterior.

Many different types of structures and walls are illustrated and discussed throughout this specification. It will be recognized by those of ordinary skill in the art that many modifications and alterations may be made to the structures illustrated and disclosed herein, to form walls and structures in various applications. For example, a circular pattern of cylindrical segment elements may be used to surround a building or a guard shack, as a security measure. The Mechanical Concrete™ described herein is highly energy absorbent, and has blast resistant characteristics. Such a structure may be used advantageously in a military theater of operation to prevent against mortar attacks, and bomb blasts, for example suicide car bomb attacks. The structure may be used for the dual purpose of preventing vehicular traffic from traveling within an encircled area, absorb an impact from a vehicle attempting to penetrate the wall or simply hitting the wall by accident, and absorb any explosion caused by explosives within the vehicle.

In accordance with another variation, a circular pattern may also be used for the foundation base for a tower, where the tower penetrates through the Mechanical Concrete™ and is attached to a plate which sits on the ground. The Mechanical Concrete™ sits on the plate and holds the tower in place against wind loads. This could be used as a quick way to install a highway lighting tower or utility tower, for example.

Another circular pattern use is in mining shafts or other large diameter shafts. The shaft wall may comprise two thinner walls, an inner and an outer wall (e.g., an annulus ring). The space between the inner and outer walls may be filled with a circular pattern of Mechanical Concrete™. The size of the main shaft diameter would be based on shaft use needs, for example ventilation, elevators, hoists, etc.

The components and teachings of the present invention may also be used to provide a base support, or underlayment for roadway applications. Typically in road construction, a backfill material is laid down, and asphalt is applied to the backfill material. Asphalt behaves much like a viscous fluid, and is often compressed and squeezed laterally under axial loads. This results in depressed areas under heavily traveled roads that correspond to the location of tire treads on heavy vehicles. Heavy vehicles often apply enough force to "squeeze" the asphalt laterally, that results in ruts or long channels in the roadway, that are visible on many busy streets. Providing lateral support to reinforce the asphalt, as described herein, may improve the ability of the asphalt to withstand higher axial loads, without substantial lateral movement. This should result in a much longer useful life of the asphalt and allow for a greater period of time before the asphalt is removed and/or overlaid.

Figure 7:
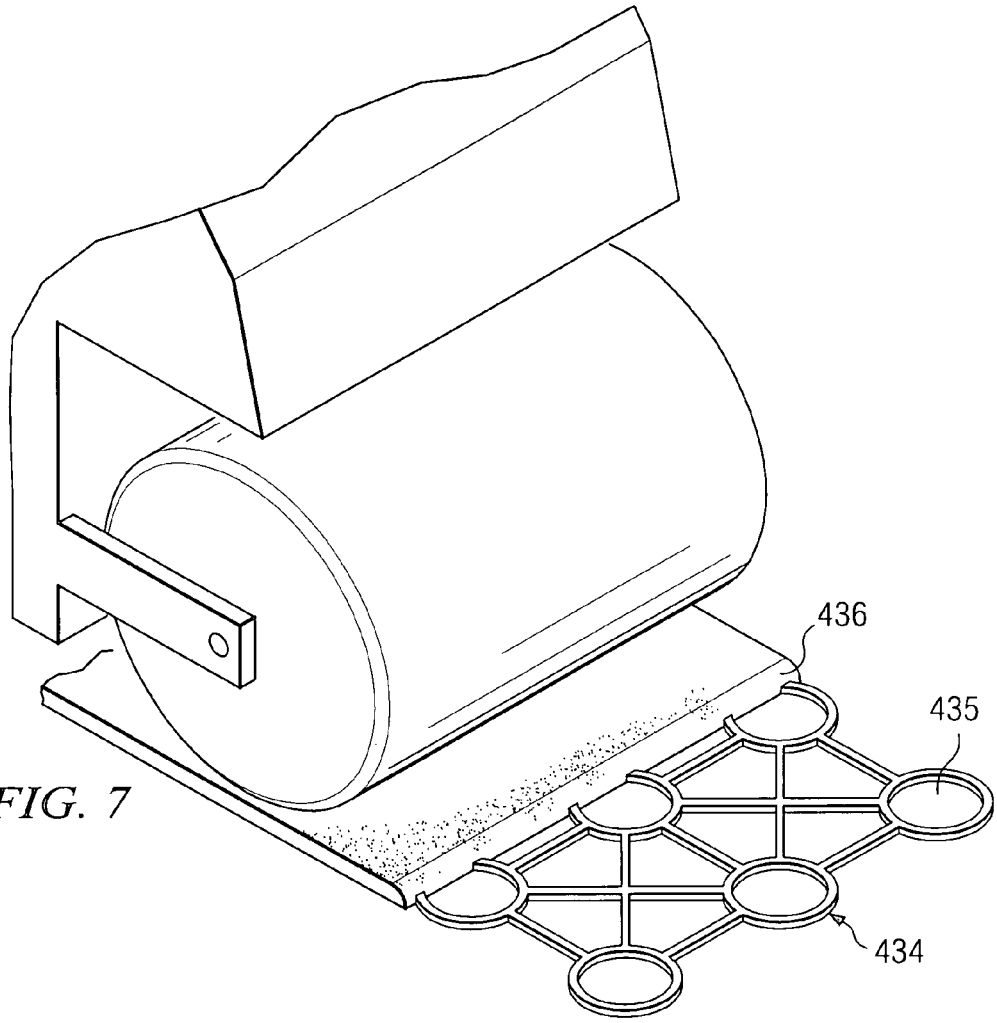
FIG. 7 illustrates a base matt being covered with asphalt, in accordance with another embodiment of the present invention.

For example, a sheet underlayment 434 is illustrated in FIG. 7, that incorporates the teachings of the present invention. Asphalt 436 is applied over, and within voids formed by underlayment 434, and fills the circular voids 435 in sheet underlayment 434. Thus, the underlayment provides a series of cylindrical segments that continuously resist tensile stresses in the asphalt that result from vertical (e.g., axial) loads.

In the illustrated embodiment of the present invention, it is envisioned that the sheet underlayment 434 might be a plastic sheet for a general service roadway wearing surface whose thickness would be engineered to the specific application. However, a sheet underlayment of practically any thickness may be used, depending on the material engineering requirements indicated by the loads. Moreover, practically any size or configuration of cylindrical voids may be provided within the teachings of the present invention. This approach to reinforcing asphalt pavement with an underlayment of tensions rings may also be used to provide tensile reinforcement to portland cement concrete pavement and slabs on grade.

Figure 8A:
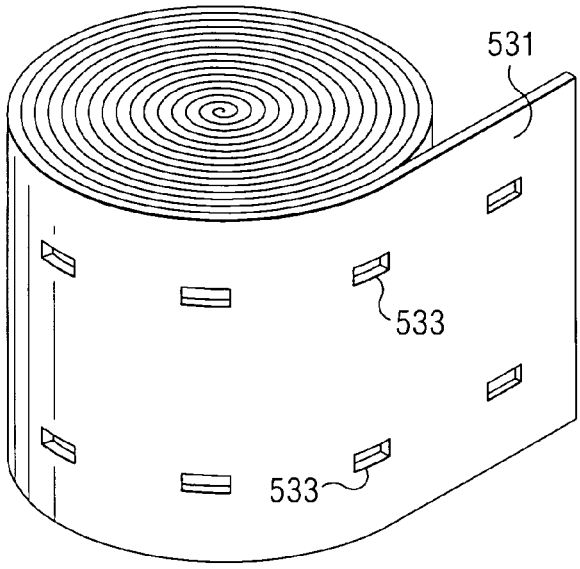
FIGS. 8A and 8B illustrate a rolled sheet of material that may be used to form cylindrical segment elements (FIG. 8B), in accordance with a particular embodiment of the present invention.

In accordance with an alternative embodiment of the present invention, sheets or rolls of material may be provided that allow for simplified mobility and ease of construction of cylindrical segment elements to be filled with aggregate material. For example, a roll of sheet material 531 is illustrated in FIG. 8A that may be used to construct tension rings for use within the teachings of the present invention. The sheet 531 is provided with a plurality of spaced voids 533, that occur in rows. In the illustrated embodiment, there are two rows of rectangular voids. However, practically any number, configuration (e.g., rectangular, square, triangular, or circular) of voids may be provided in practically any pattern, to accommodate various applications. For example, in a particular embodiment of the present invention, chicken wire may be used in lieu of sheet 531, to form cylindrical segment elements.

When a section of the roll of sheet material is cut from the roll it can be coiled to form a ring that can be used in accordance with the teachings of the present invention. When the desired circumference is attained, ties 537 may be inserted through voids 533 of a front portion of the sheet, and a rear portion of the sheet, binding the two ends together to form a ring 534 (See FIG. 8B). The ties 537 can be formed of practically any material, for example, metal, plastic or a composite. Since the lateral tensile stresses are small, relative to the axial force to be placed upon the aggregate, the stress on the ties will be relatively small as compared to the axial load that is supported by the reinforced aggregate particle unit that is formed when ring 534 is filled with aggregate particles. The configuration of the roll of sheet material allows for ease of transportation to the location in which the tension rings 534 will be used.

Figure 8B:
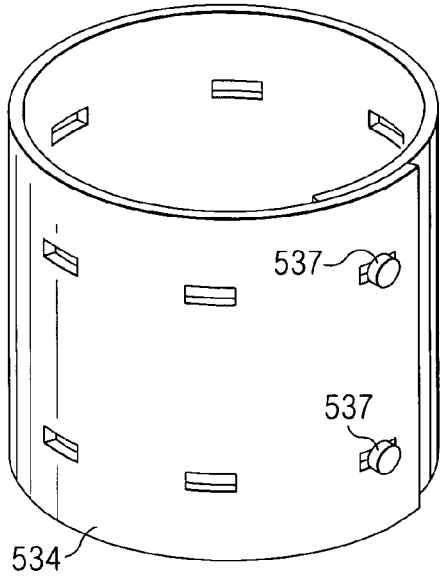

In accordance with another embodiment of the present invention, ties, studs or other fastening devices may be incorporated into the roll of sheet material, allowing the tension rings to be formed by simply: (i) cutting a sufficient length to form the appropriate circumference to the tension ring; (ii) snapping together two ends of the cut sheet (using fasteners 537) to form a tension ring; and (iii) filling the tension ring with aggregate particles. In one embodiment, the fasteners may be studs that project from the roll of sheet material in a pattern similar to voids 533. In the embodiment of FIG. 8B, the studs include a circular head of a larger diameter than the thin dimension of rectangular void 533. Thus, fasteners 537 may be "snapped" through voids 533 to hold two ends of the sheet together to form a circular element (as illustrated in FIG. 8B).

Figure 9:
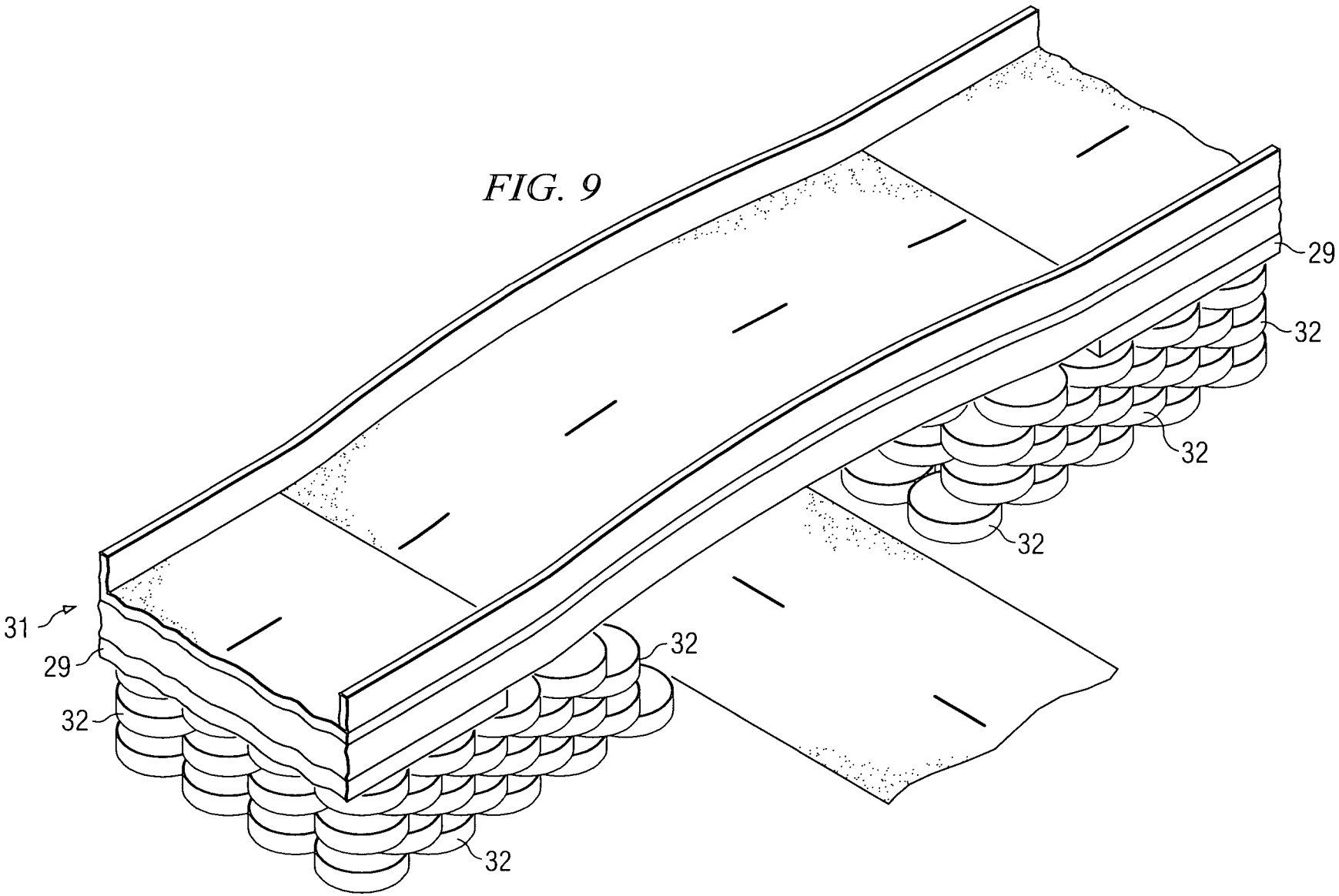
FIG. 9 illustrates two bridge abutments, formed in accordance with the teachings of the present invention.

FIG. 9 illustrates an embankment system in which reinforced aggregate particle units 32 may be incorporated into the foundation of a simple bridge abutment to support bridge beams 29. Simple bridge abutments are usually concrete end supports on which rest the beams which make up a bridge 31.

Figure 10:
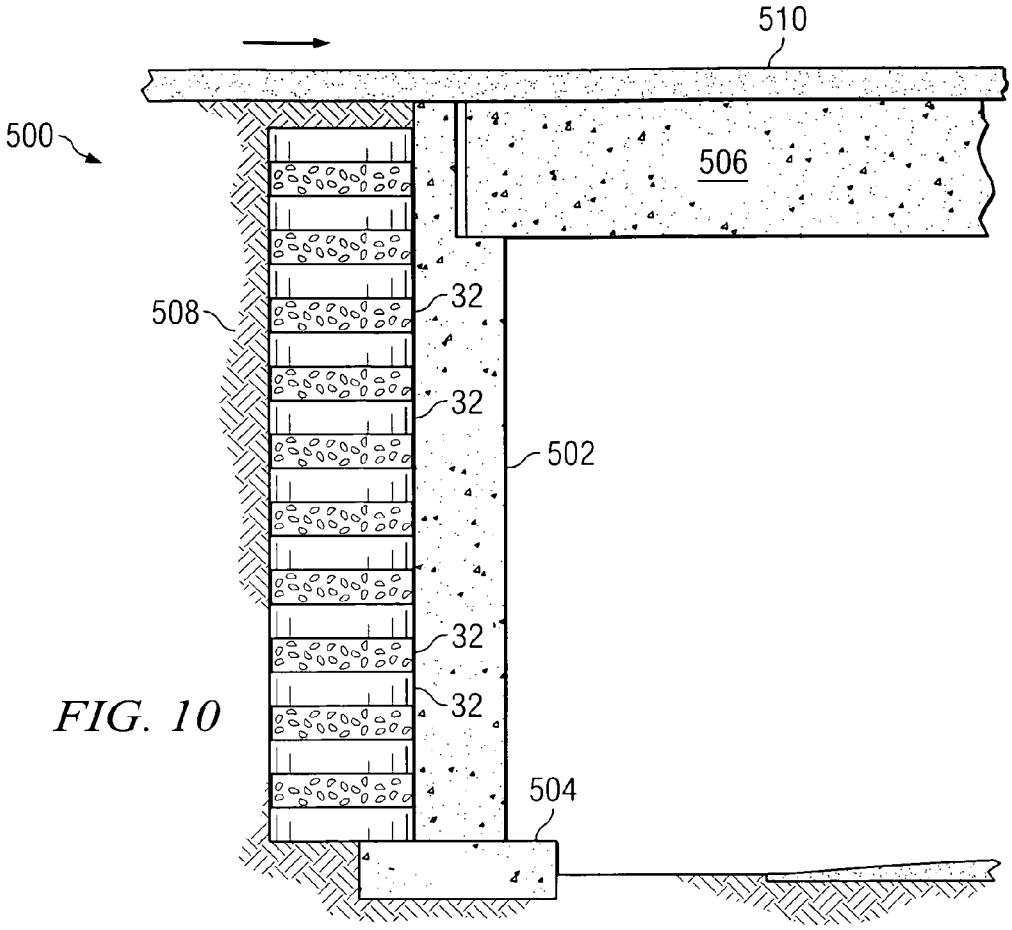
FIG. 10 illustrates a portion of a bridge having an integral bridge abutment, and formed in accordance with the teachings of the present invention.

FIG. 10 illustrates an alternative embodiment of the present invention in which reinforced aggregate particle units 32 are used behind a bridge abutment on a bridge 500 with an integral abutment. Integral abutments are designed to move when the bridge moves due to thermal expansion and contraction and due to load induced deflection. The bridge abutment of FIG. 10 includes an integral beam abutment wall 502 and an abutment wall footing 504. A bridge is considered to have an integral abutment when the bridge beams 506 are rigidly attached to the abutment. A bridge deck 510 is disposed above bridge beam 506. A single row of reinforced aggregate particle units 32 extends from the top of the footing to the top of the wall, and ends just below the roadway surface.

As with most bridge abutments, integral abutments typically have the additional function of retaining a portion of the earth fill 508 for bridge approaches. Thus, added width is usually required for the back wall 502, which retains approach fill and protects the abutment end section of the superstructure.

Bridge abutments are basically wall piers with flanking (wing) walls. The wing walls and sidewalls, which retain approach fill, should have adequate length to prevent erosion and undesired spill or spreading of the backfill. Typically, bridges with integral abutments are designed to "give" or move slightly under pressure. However, when an abutment is backfilled, the abutment can build up active earth pressure due to water getting into the fill or bridge movements due to thermal expansion. The teachings of the present invention assure a passive earth pressure that allows the abutment wall to give and move with changing load conditions. Furthermore, the use of reinforced aggregate particle units in accordance with the teachings of the present invention, as bridge support structures and in conjunction with more traditional concrete support structures allow for significant positive drainage of groundwater, rainwater, etc.

The bridge abutments of FIGS. 9 and 10 include an exposed embankment structure of reinforced aggregate particle units 32, that is well suited for temporary structures. It should be appreciated that the structure could be covered with soil, landscape or other architectural finish to improve the aesthetics of the bridge. The temporary bridge of FIG. 9, for example, can be built much more quickly than traditional bridges that require concrete structure and the associated specialized material, equipment and conditions to erect.

Figure 11:
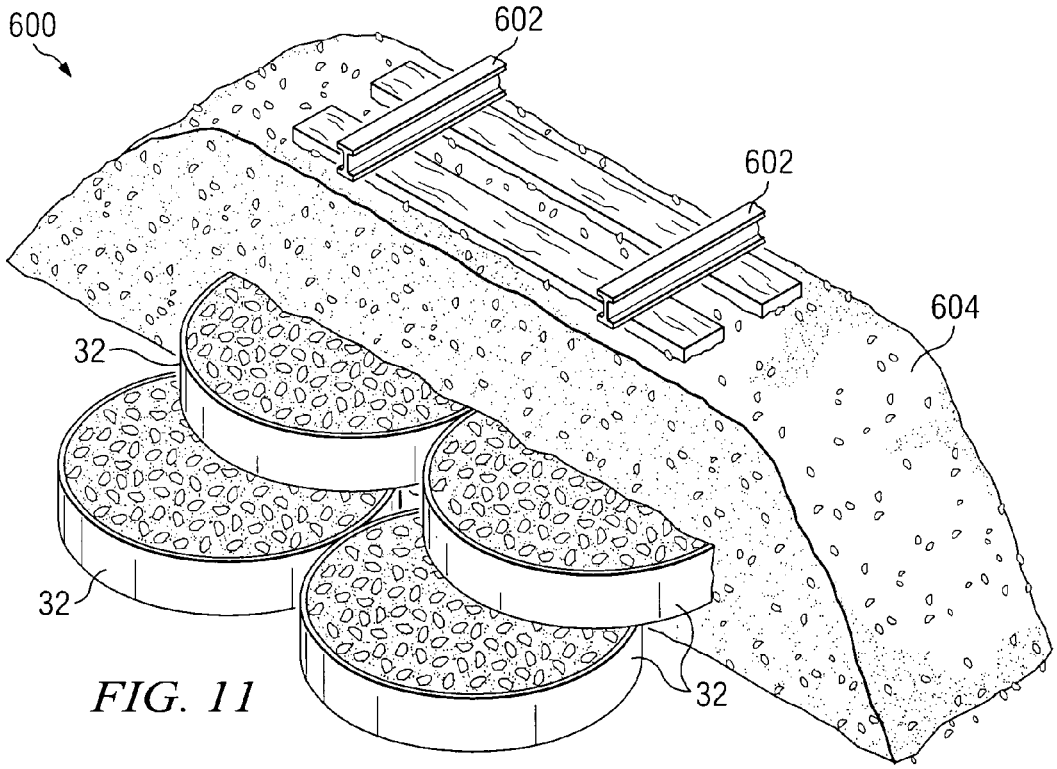
FIG. 11 illustrates a railroad bed including a support structure formed in accordance with the teachings of the present invention.

FIG. 11 illustrates yet another alternative embodiment of the present invention, in which reinforced aggregate particle units 32 are used as part of a support structure of a railroad bed 600. In the illustrated embodiment, two layers of elements are disposed below each rail 602, which are separated by the standard gauge of four feet, eight and one half inches. However, any number of columns or rows of reinforced aggregate particle units may be used, within the teachings of the present invention.

The reinforced aggregate particle units are arranged such that they form a continuous row underneath rails 602, each reinforced aggregate particle unit being in contact with the next along the row. The second layer of reinforced particle units may be offset in the direction of the rails, by one-half of the diameter of the reinforced aggregate particle units. In this manner, the reinforced aggregate particle units are staggered in the direction of the rail, much like a course of bricks. Ballast material 604 is disposed beneath rails 602 and above reinforced aggregate particle units 32.

The teachings of the present invention may also be used to construct a column(s), in accordance with the teachings of the present invention. The column can be created by filling a circular pipe with aggregate with the design load directed to the aggregate and not on the pipe itself. In this manner, the applied load is like a piston pressing down on the aggregate within the pipe. The pipe is configured to only support the lateral pressure generated by the design load and does not directly support the design load like a concrete filled steel pipe column. This also suggests a new way to reinforce a redimix concrete column: a concrete filled circular pipe column with the design load only on the concrete and not the containing pipe. One way such a column can be created is by stacking cylindrical segment elements vertically on top of one another. These cylindrical segments may be a tire with both sidewalls removed or a similar device (i.e., cylindrical segment elements with a partial floor). The partial floor allows for simplified horizontal and vertical alignment of adjacent cylindrical segment elements.

The column described above can be extended into a wall by constructing a plurality of columns side by side. For example, in accordance with a particular embodiment, of the present invention, the column described above can be extended into a wall by horizontally connecting each cylindrical segment element to at least one horizontally adjacent cylindrical segment element at their mutual contact point, using a connector (e.g., bolt, push fastener, etc.). The cylindrical segment elements may then be stacked on top of each other to the desired height of the wall. This is similar in appearance to a stacked block wall.

In accordance with a further embodiment of the present invention, the cylindrical segment elements may be further interconnected between the above described bolt connectors to adjacent bolt connectors in both the horizontal and vertical directions by wires, links or straps. These wire connectors serve to further integrate vertically stacked Mechanical Concrete™ elements into a larger structure. Bolting or fastening occurs between Mechanical Concrete™ in the horizontal plane. Linking with wires and straps in between bolts and can occur in both the horizontal and vertical directions.

Figure 12B:
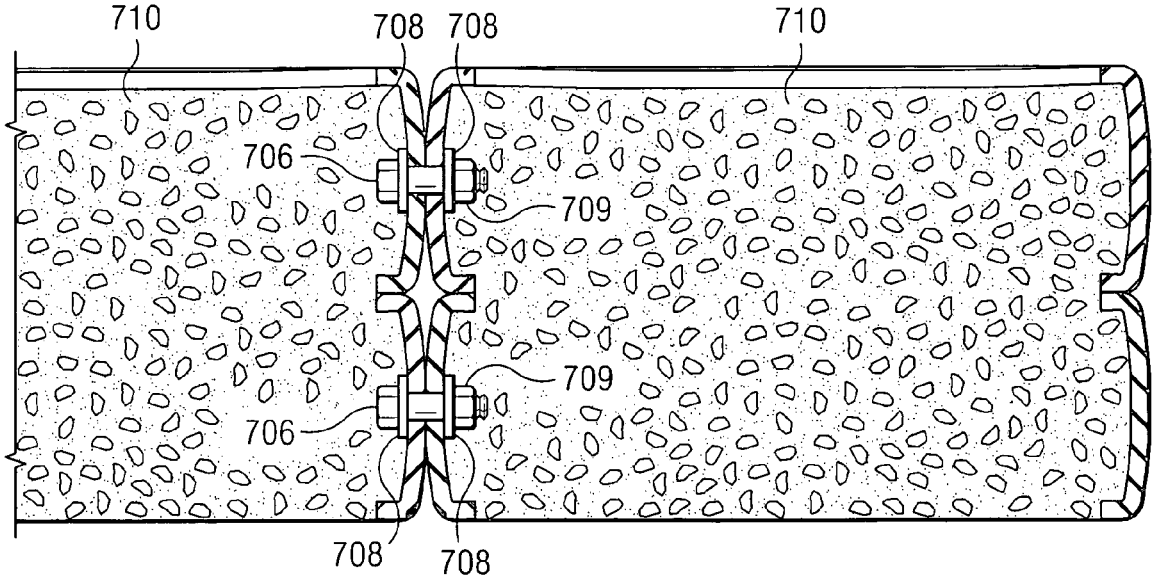
FIGS. 12A and 12B (hereinafter, collectively "FIG. 12"), illustrate a structure comprising tires with both sidewalls removed and aggregate particles, in accordance with another embodiment of the present invention.

In accordance with a particular embodiment of the present invention, tires having both sidewalls removed may be used to form cylindrical segment elements. Both sidewalls must be removed, in this embodiment, in order to form a "tubular" cylindrical segment element. However, it is anticipated (and within the scope of this invention) that a small "lip" may remain if the sidewall is not perfectly removed in this process (e.g., as shown in FIG. 12B). The removal of both sidewalls allows for better communication of aggregate through the cylindrical segment elements, and the structure generally, to allow for better compaction of aggregate particles during construction of the structure, and enhances the structure's ability to withstand greater axial (compressive) loading on the aggregate particles.

Figure 12A:
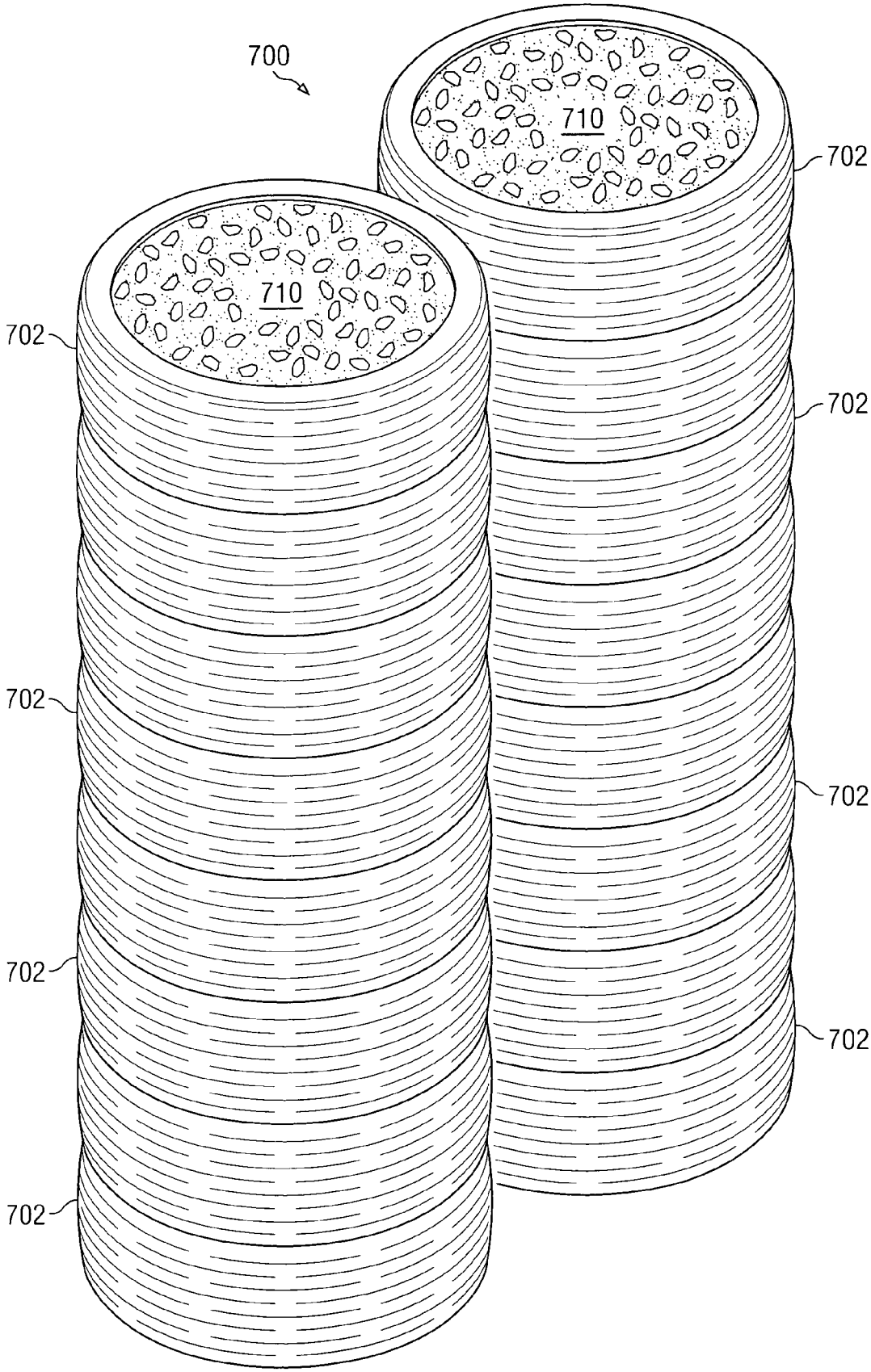

FIG. 12 illustrates another embodiment of the present invention, in which modified scrap tires and aggregate particles are used to construct a Mechanical Concrete™ structure 700, in accordance with the teachings of the present invention. In this embodiment, eighteen scrap tires 702 are used to construct the structure 700. Each scrap tire is comprised of a P195/65R15 from various manufacturers. Each scrap tire has both sidewalls removed and one, three-eights inch (0.375") diameter hole 704 drilled into the center of the tread. Each tire (as modified) measures approximately twenty-four and one-quarter inches (24.25") outside diameter and approximately seven and one-quarter inches (7.25") wide across the tread.

In order to construct structure 700 of FIG. 12, tires 702 were initially paired together and bolted together (in sets of two) using a seven-sixteenth inch (7/16") diameter bolt 706 by one and one-half (1-½") in length, with two standard washers 708 placed against the tires, one at the head of the bolt, and one in front of the nut 709. The second pair was visually centered and aligned on top of the filled and tamped first tire pair.

Stone 710 is comprised of a standard available #8 specification limestone. This name, #8's, defines the amount passing the number 8 screen and the West Virginia Department of Highways specification. The stone was comprised primarily of three-eights inch (⅜") and one-quarter inch (¼") material with very few fines. This type of stone is commonly specified for highway, utility bedding and general construction uses.

As illustrated and described with regard to FIG. 12, the tires have both sidewalls removed, and lie generally flat on the aggrages of the tire below. In accordance with particular applications, this is beneficial for several reasons. For example, the open top allows the aggregates to be placed with ease and compacted as needed. The small lip, a partial floor, that remains on the bottom of the tire continues to provide the tread of the tire with structural stability to allow the aggregate filling to proceed without the tread collapsing under the weight of misguided aggregate, during the filling process. The presence of the small lip also allows an upper tire to be placed and positioned accurately on top of the aggregates which fill the tires below it.

Moreover, the open top allows the connecting of the tire treads to each other with bolts, push fasteners and similar devices. This occurs because the open top allows the holes that have been drilled accurately at specific positions in the treads of adjacent tires to be easily matched against one another. If both sidewalls were present, completely filling the tire interior with aggregate would be somewhat complicated. Any lack of complete filling would not allow the upper tires to seat properly on the tires below, and in full contact with the aggregate below. This could cause tilting of the wall structural system so that a level, plumb system would not be easily achievable. On the other hand, complete filling of a tire with both sidewalls removed leaving a small lip is assured by observation. Simple measurements with a carpenter's level and/or a string line can assure a level and plumb wall system.

Furthermore pairs of tires connected in this manner may be arranged in each layer by offsetting and turning at right angles to be interlocked horizontally with other connected pairs in the layer above and the layer below to create a larger wall structure in both plan view and side views. This interlocking of connected pairs in adjacent layers reduces the amount of scrap tire processing by drilling one hole in each tire, creates a larger building unit with the pair of tires for more extensive walls and eliminates the need for side walls 452 in FIG. 6*c*.

Although the present invention has been described with reference to a few particular embodiments thereof, it should be understood that those skilled in the art may make many other modifications and embodiments thereof which will fall within the spirit and scope of the principles of this invention.

What is claimed is:

1. A method for forming a structure, comprising:

arranging a first plurality of cylindrical segment elements on a surface, each of the first plurality of cylindrical segment elements comprising a tire having both sidewalls substantially removed to form a continuous tension ring, and defining a first cylindrical void therein;

each of the first plurality of cylindrical segment elements is a generally tubular configuration, and has a respective ratio of wall thickness to diameter that is equal to or less than 1:20; and pouring aggregate particles over the first plurality of cylindrical segment elements such that the first cylindrical voids are substantially filled with aggregate particles, and the first plurality of cylindrical segment elements limit lateral movement of the aggregate particles.

2. The method of claim 1, wherein the first plurality of cylindrical segment elements form a first layer, and further comprising:

arranging a second plurality of cylindrical segment elements above the first plurality of cylindrical segment elements, each of the second plurality of cylindrical segment elements defining a second cylindrical void therein; and pouring additional aggregate particles over the second plurality of cylindrical segment elements such that the second cylindrical voids are substantially filled with aggregate particles.

3. The method of claim 2, further comprising arranging the second plurality of cylindrical segment elements such that longitudinal, central axes of the second plurality of cylindrical segment elements are offset from respective longitudinal, central axes of the first plurality of cylindrical segment elements, by approximately one-half of a diameter of the first plurality of cylindrical segment elements.

4. The method of claim 1, further comprising applying an axial load to the aggregate particles, such that lateral stresses generated by the aggregate particles as a result of the axial load are transmitted to the first plurality of cylindrical segment elements.

5. The method of claim 1, wherein the cylindrical segment elements are stacked vertically on top of one another to form at least one column, and the aggregate particles comprise rock.

6. The method of claim 1, wherein the cylindrical segment elements each include a respective weight that is less than or equal to ten percent of a weight of the aggregate particles required to fill the respective first cylindrical void.

7. A method for forming a structure, comprising:

arranging a first plurality of cylindrical segment elements on a surface, each of the first plurality of cylindrical segment elements defining a first cylindrical void therein;

each of the first plurality of cylindrical segment elements is a generally tubular configuration, and has a respective ratio of wall thickness to diameter that is equal to or less than 1:20; and pouring aggregate particles over the first plurality of cylindrical segment elements such that the first cylindrical voids are substantially filled with aggregate particles, and the first plurality of cylindrical segment elements limit lateral movement of the aggregate particles; and wherein the first plurality of cylindrical segment elements are integral to a base mat and the aggregate particles comprise asphalt, and further comprising compacting the asphalt such that a portion of the asphalt becomes compressed within the cylindrical voids.

8. A structure, comprising:

a first plurality of cylindrical segment elements arranged upon a surface, each of the first plurality of cylindrical segment elements comprising a tire having both sidewalls substantially removed to form a continuous tension ring, and defining a first cylindrical void therein;

each of the first plurality of cylindrical segment elements is a generally tubular configuration, and has a respective ratio of wall thickness to diameter that is equal to or less than 1:20; and aggregate particles disposed at least partially within the cylindrical voids and substantially filling the cylindrical voids.

9. The structure of claim 8, further comprising:

a second plurality of cylindrical segment elements arranged over the first plurality of cylindrical segment elements, each of the second plurality of cylindrical segment elements defining a second cylindrical void therein; and the aggregate particles being disposed at least partially within the second cylindrical voids.

10. The structure of claim 9, wherein the second plurality of cylindrical segment elements are arranged such that cylindrical axes of the second plurality of cylindrical segment elements are offset from respective cylindrical axes of the first plurality of cylindrical segment elements by approximately one-half of a diameter of the first plurality of cylindrical segment elements.

11. A structure, comprising:

a first plurality of cylindrical segment elements arranged upon a surface, each of the first plurality of cylindrical segment elements comprising a tire having both sidewalls substantially removed to form a continuous tension ring, and defining a first cylindrical void therein;

each of the first plurality of cylindrical segment elements comprising a respective generally tubular configuration, and having a respective ratio of wall thickness to diameter that is equal to or less than 1:20;

aggregate particles disposed at least partially within the cylindrical voids and substantially filling the cylindrical voids;

a second plurality of cylindrical segment elements arranged over the first plurality of cylindrical segment elements, each of the second plurality of cylindrical segment elements defining a second cylindrical void therein;

the aggregate particles being disposed at least partially within the second cylindrical voids; and wherein each of the first and second plurality of cylindrical segment elements comprising a tire having both sidewalls substantially removed to form a continuous tension ring, and the aggregate particles comprise stone.

12. A structure, comprising:

a first plurality of cylindrical segment elements arranged upon a surface, each of the first plurality of cylindrical segment elements defining a first cylindrical void therein;

each of the first plurality of cylindrical segment elements is a generally tubular configuration, and has a respective ratio of wall thickness to diameter that is equal to or less than 1:20; and aggregate particles disposed at least partially within the cylindrical voids and substantially filling the cylindrical voids; and wherein the first plurality of cylindrical segment elements are integral to a base mat and the aggregate particles comprise asphalt roadway material.

* * * * *